US012116165B1

(12) United States Patent
Horian

(10) Patent No.: US 12,116,165 B1
(45) Date of Patent: Oct. 15, 2024

(54) SMALL PARTS CONTAINER

(71) Applicant: Richard Horian, Riverview, FL (US)

(72) Inventor: Richard Horian, Riverview, FL (US)

( * ) Notice: Subject to any disclaimer, the term of this patent is extended or adjusted under 35 U.S.C. 154(b) by 0 days.

(21) Appl. No.: 18/590,474

(22) Filed: Feb. 28, 2024

(51) Int. Cl.
*B65D 21/02* (2006.01)
*B65D 43/16* (2006.01)
*B65D 83/04* (2006.01)

(52) U.S. Cl.
CPC ..... *B65D 21/0201* (2013.01); *B65D 43/162* (2013.01); *B65D 83/0445* (2013.01)

(58) Field of Classification Search
CPC ..... B65D 21/0201; B65D 43/162; B65D 83/0445; A61J 7/0084; A61J 7/0069; A61J 1/03; A61J 7/04; A61J 1/035
USPC ..... 206/5.1, 538, 539, 558, 534.1
See application file for complete search history.

(56) References Cited

U.S. PATENT DOCUMENTS 3,139,208 A * 6/1964 Irwin ..... B44D 3/00 47/87
4,262,802 A 4/1981 Laauwe
6,595,365 B1 7/2003 Wigmore
7,374,111 B2 * 5/2008 Joseph ..... B05B 7/247 141/2
8,794,482 B2 8/2014 Sack et al.
9,757,886 B2 9/2017 Middleton et al.
10,058,480 B2 8/2018 Janson et al.
2005/0254880 A1 * 11/2005 Brajdic ..... B44D 3/22 401/35
2007/0062964 A1 3/2007 Kampf et al.
2007/0228047 A1 * 10/2007 Pehr ..... B65D 83/0445 220/524
2017/0121076 A1 * 5/2017 Weinstein ..... A61J 1/00
2017/0273871 A1 * 9/2017 Glazer ..... A61J 7/0084

OTHER PUBLICATIONS

MIT course handout, Design Issues on Living Hinges.

* cited by examiner

*Primary Examiner* — Jeffrey R Allen

(57) ABSTRACT

The invention is a plastic storage case predominantly for small parts that consists of a plurality of joined storage compartments with each having a snap cover lid that are joined to the compartment via a living hinge forming a full enclosure that can be opened and closed easily. A unique aspect of the invention is that it can contain many joined storage compartments in one integral unit made of a single recyclable plastic such as High Density Polypropylene. When use is complete, this allows the entire package to be placed in a recycle container and then ground up to be molded again making new parts.

10 Claims, 3 Drawing Sheets

SMALL PARTS CONTAINER

FIELD OF THE INVENTION

The invention relates to a plastic storage case predominantly for small parts that consists of a plurality of joined storage compartments with each having a snap cover lid that are joined to the compartment via a living hinge forming a full enclosure that can be opened and closed easily.

BACKGROUND OF THE INVENTION

In the U.S. there are over four million people with crippling hand arthritis. This group has always struggled with "pill and capsule blister packaging" for example. Many have found it virtually impossible to wrestle with these 'bubble packs' resorting to using sharp objects like scissors, knives, and razors to break through the protective, formed plastic bubble covering the pill. Another opening of this type of package that has proven terrible failures is known as the "push through" blister package. This package requires the user to push on the plastic bubble until the pill or capsule pierces and breaks through an aluminum foil covering. This can leave 'shards' of foil that sticks to the fingers or medicine and is swallowed with the pill.

These shards are of extreme importance because once they break away from the blister they shatter inside the patient and wedge themselves in the throat, stomach lining and intestines to make it extremely difficult to remove them. These shards also cause health predicaments as they wedge themselves into vital origins of the inner body. In some cases people have actually swallowed the entire blister pill assembly consisting of the PVC base, aluminum folder barrier, adhesive holding one or more parts together along with paper or cardboard.

Utrecht University in the Netherlands conducted a large case study on the use of blister packs with 5177 participants. Regardless of the type of blister pack used, 46.2% of the people in the study reported problems opening and using blister packed medications.

Injury is another frequent concern with blister-packaged pills. People cut themselves trying to open blister packs using knives, razors, paper clips, scissors, and hundreds of other sharp objects that can open wounds instead of the blister packaging as intended.

Not only have many instances of the inadequacies of blister packs been noted by the impaired. But by far the largest by many times fold affected by poor blister designs have not yet been mentioned. The elderly and the impaired, including both physically as well as mentally, are just unable to deal with the incredibly poor designs rendered to date on blister pack design. With the elderly, the handicapped, and the otherwise impaired are included in this number of people not being served by poorly designed blister packs. The shortcomings of existing blister pack designs are acknowledged. See van Geffen et al., "Problems with medicine packages: experiences reported to a Dutch medicine reporting system" (2010) https://pubmed.ncbi.nlm.nih.gov/20442349/

Most blister packs are made of PVC vacuum-formed or molded to form 'bubbles' that contain pills and capsules. These bubbles are then adhered with adhesive to a backing material of paper, cardboard, dissimilar plastic, or aluminum foil. Thus, several different materials must be considered when trying to recycle some four million tons of blister packaging waste. It is quite difficult or impossible in some cases.

A number of pill organizers are currently on the market that provide a limited number of discrete containers, e.g., 7-14, integrally molded back-to-back as a single unit. These devices are intended for users to fill with a variety of their own pills, capsules, or other small products. Such devices are not readily formed in groups of 10, 20, 40, or even 60 units such that they might serve as sealed pill or capsule medications as a replacement for multi-material blister pack assemblies.

It would be desirable to have a structure array to contain small items that can provide rows multiple containers that can be formed at the same time with one mold.

It would also be desirable to have a molding process in which the injection hole allows multiple rows to be molded in a one shot cycle without the assistance of slides or other separate mechanical aids.

Further, it would be desirable to have a process that would allow the single injection of multiple, closable, containers from one uniform material allowing for recycling of a single plastic material without the need to separate the waste packaging into multiple, different, components.

SUMMARY OF THE INVENTION

In accordance with the objects noted above and those that will become apparent from the description herein, a small parts package according to the invention comprises a single piece made of a single material without any separate added components included in the composition. The package includes multiple (e.g., up to about 120), separate containers attached to a common base plate with holes included in the plate to allow a core portion of an injection mold to pass through the plate and form the separate containers.

Each container consists of a four walled container protruding from the plate and each cavity includes an integrally attached lid that fits securely over the container and protects its contents from external dust, dirt, moisture and or gases. An integrally attached lid with a living hinge covers the container and forms a secure friction fit over the container. The lid is joined to the plate via a living hinge that allows the lid to be formed at the same time and in the same mold as the container and fold over completely to insure a complete coverage of lid over the container. The singular material that comprises the package is recyclable in its totality. The small parts package is used for the storage and or packaging of small items such as screws, washers, electronic parts, powders, medical pills, and capsules as well as other medical components. The tubs are formed in rows with a core allowance space that is adjacent to each row to allow molding of the lid.

DETAILED DESCRIPTION OF THE INVENTION

Figure 1:
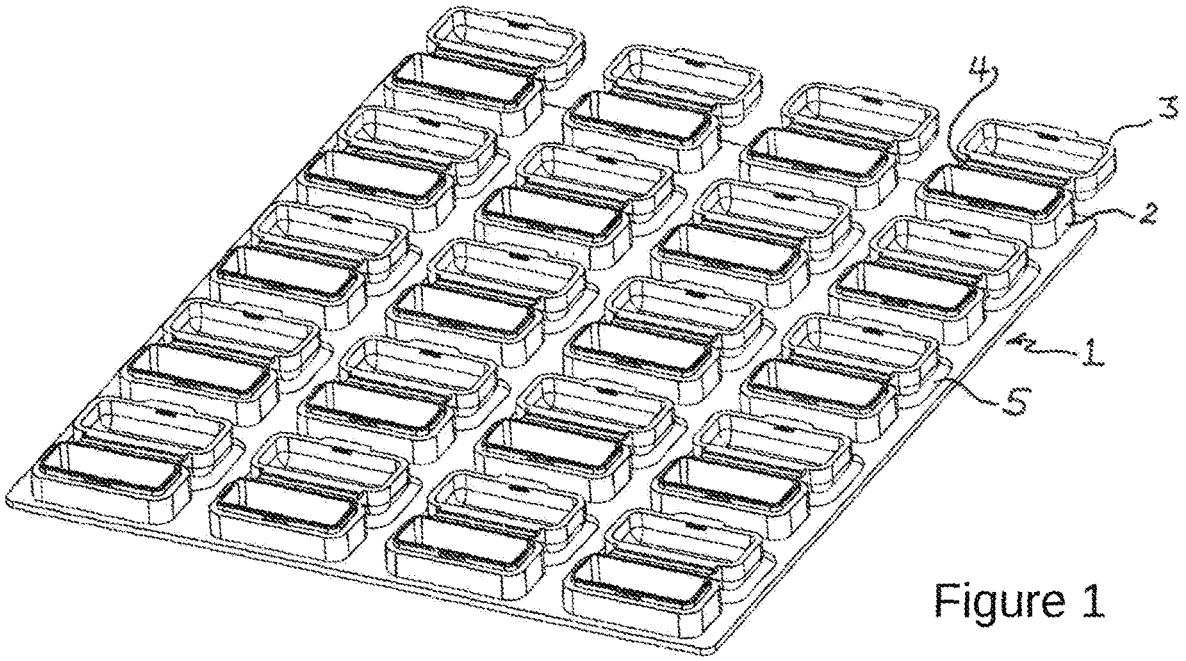
FIG. 1 is a front isometric view of a capsule container array according to the invention.

An array of small parts containers made from an array of containers on a base plate and container snap-caps joined to the containers by living hinges therebetween. Such container arrays are intended to serve as a replacement for the multi-material blister packaging. If desired, the formed array of containers made according to the invention may be subdivided into units of smaller dimensions for convenient retail display in a suitably sized box. Holes are used through the base in front of the formed container during molding to allow the mold core through the base to form the lid tops.

The individual containers in the array of the present invention can be of virtually any desired volume that depends on the intended contents. For example, regular aspirin tablets are about 11 mm in diameter and a rounded height of 5 mm. When inserted into a container, that pill would require internal dimensions of at least 11 mm in two dimensions and 5 mm in the remaining dimension for a volume of 605 $mm^3$. Containers to hold a single aspirin in a manner that would allow easy removal would an individual container volume within the range of 625-800 $mm^3$. If two tablets are presented in the same container, the required volume would be about twice that of an individual tablet, i.e., 1250-1600 $mm^3$. A typical gel capsule sold for treating the symptoms of the flu is roughly 20 mm in length and 10 mm in diameter for a minimum required container volume of 2000 $mm^3$ to hold that capsule. Allowing some clearance for insertion and removal would suggest a container volume of about 2200 $mm^3$ per capsule and a volume within the range of about 2100-3000 $mm^3$ for a single capsule, twice that for two capsules, i.e., 4200-6000 $mm^3$.

Two materials that are ideally suited for use in this invention are 100% high density polypropylene plastic or 100% high density polyethylene. Alternatively, the container array of the present invention can be made from biodegradable materials that will break down in the human gut if accidentally ingested. The container may be used for storage of hundreds of different small parts such as diodes, LED's washers, nuts, screws, bolts and especially medical pills and capsules. The living hinges allow the pill holder lids to include a snap closure mechanism to keep the lid and base fixed together until ready for use.

To facilitate the one piece closure there is a hole in the base behind the lid of such dimension to allow space for the core of the injection mold to pass through it to form the lid covers as well as the base at the same time. This arrangement allows a multitude of lids to be permanently attached to the base without limit. Current devices of similar design can only allow a limited number of attached pill holders as they are fixed together 'back to back".

The lid of the current invention is sized to totally enclose the pill, pills or capsule when snapped in place to prevent foreign matter, moisture, and unnecessary airborne gases to infiltrate the medicine between the base and lids. The snap closure between the lid and base requires very little pressure to open the lid to retrieve the medicine to facilitate the millions of people that are limited or incapacitated with restraining mental conditions or physical restrictions or impairments of the hands, fingers, arms, or other physically-based restraints. The lids attached to the base via the living hinges that provide a separate, self-contained base for each pill or set of pills or capsules.

An important feature is that the container is made of one uniform material that is totally recyclable without further handling or stripping of attached foreign parts. When done with the container, it may be then thrown into the recycler to be ground up and inserted into a injection molding machine to make new parts of value.

Preferably, the container array is made from a material that is translucent such that a user can see whether a particular container has something therein. A translucency within the range of 10-100% (transparent or substantially so), preferably a range of 25-70%, and even more preferably within a range of 35-65%.

The invention has another unique characteristic. The lid that covers the pill, the locking assembly that holds down the lid when not in use, and the cavity that contains the pill or pills. For use, the patient simply flips up the lid and retrieves the pill, pills, or capsule. Even simpler yet, the patient can pop open the top and turn the whole case upside down so that the pill(s) or capsule simply fall into their open hand without restriction. There is no picking away at the pill to get it out of its holder carrying aluminum foil shards with it.

The lid is held to the base by a 'tongue and groove' mechanism of required length and depth required for the task. The 'tongue' is a protruding bar projecting inwardly from the lip of the cap. The 'groove' is an indentation or undercut portion in the base lip. The top engages in a snap-cap manner when the lid's lip engages the undercut in the lip of the bottom. Extending or diminishing the tongue or groove will dictate how hard it is to open the cover from the base. This is particularly important when adjusting the package for children's difficulty being tailored to appropriately open the package with safety in mind.

Problems:

(1) Existing blister pack designs are difficult to open, especially by those of special needs (e.g., limited dexterity, mental acuity, or physical limitations).

(2) The current blister packs are dangerous to open because they often need sharp tools.

(3) Once opened, aluminum foil shards cling to the pill or the user's fingers and are readily swallowed with the pill.

Solutions:

(1) The present packaging offers a lid opening system that is easy to open without tools.

(2) The materials of the present packaging are soft plastic that do not present sharp edges that can cut the skin.

(3) The present packaging can be sterilized and reused many times, thereby reducing unrecyclable medical waste.

(4) It is virtually impossible for someone to swallow any part of the package that could cause choking as the entire package is one piece and therefore too large.

(5) No other package allows dispersing the correct dosage without error. Lift up the lid, turn the package upside down, and the pill or pills as required fall gently into the hand without sticking or wedging together.

(6) A serious contribution is made towards solving the world's medical waste disposal problem. There is no waste or cost in separating materials as is the case with blister packs now. Use the product and the package is ready for immediate recycling without further processing.

Thus, we have a new and useful pill container design that may be used by millions of special needs people without any difficulty while also helping to reduce unrecyclable waste. It is estimated that over 35 billion blister packs of the same wasteful and polluting design will be in use unless an improved design is offered as requested by the United States National Institute of Health. Within the invention we also have the means for people to help prevent severe injury when using a product that was designed to help them.

When the product is molded it is in the form of a flat tray approximately 0.040" thick that has protruding cavities (or cups) connected to a living hinge followed by a spacing that is large enough to bend the cups over and attach them via friction to protrusions rising above the tray to hold the cups in position. A pill, pills, or capsule is placed inside the cup which is then manually pried off the raised holder to provide access to the medicine. The pills are then retrieved manually, or the tray is inverted to allow the pills to fall into the user's hand.

Figure 5:
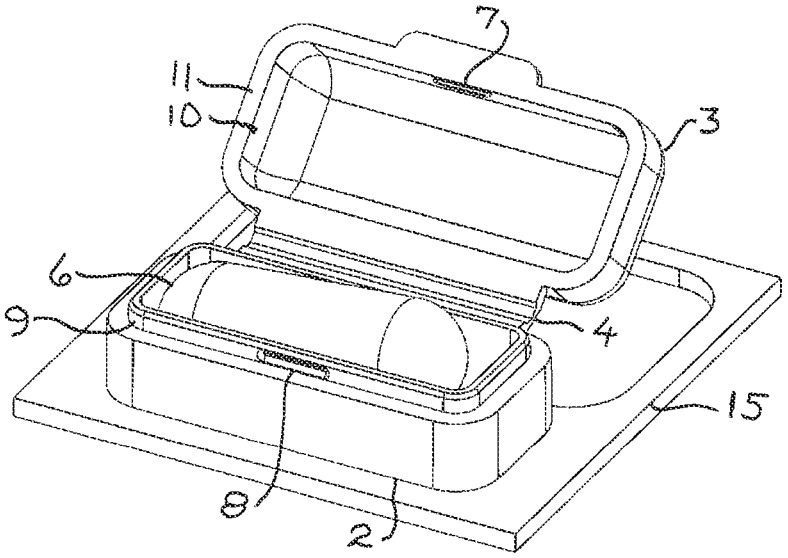
FIG. 5 is a detailed view of one of the containers from the array in FIG. 1 with a capsule therein.

The invention is conveniently described in connection with a couple of preferred embodiments that are shown in the attached figures. FIG. 1 shows an array 1 of twenty capsule containers 2 in a 5×4 array. Each container 2 is integrally formed with snap-cap top 3 on living hinge 4. Under each top 3 within array 1 is an opening 5 directly beneath top 3. In general, capsule containers 2 are configured to exhibit a generally rectangular shape of dimensions suitable for an elongated capsule, such as a conventional gel capsule 6 (see FIG. 5). Each snap-cap top 3 is preferably formed with an overhang portion 7 that engages undercut portion 8 in lip 9 of capsule container 2. Lip 9 fits within recess portion 10 formed into the inside edge 11 of snap-cap top 3. When engaged, lip 9 fits within recess portion 10 and is releasably secured in position by the interaction of overhang portion 7 with undercut portion 8.

Figure 2:
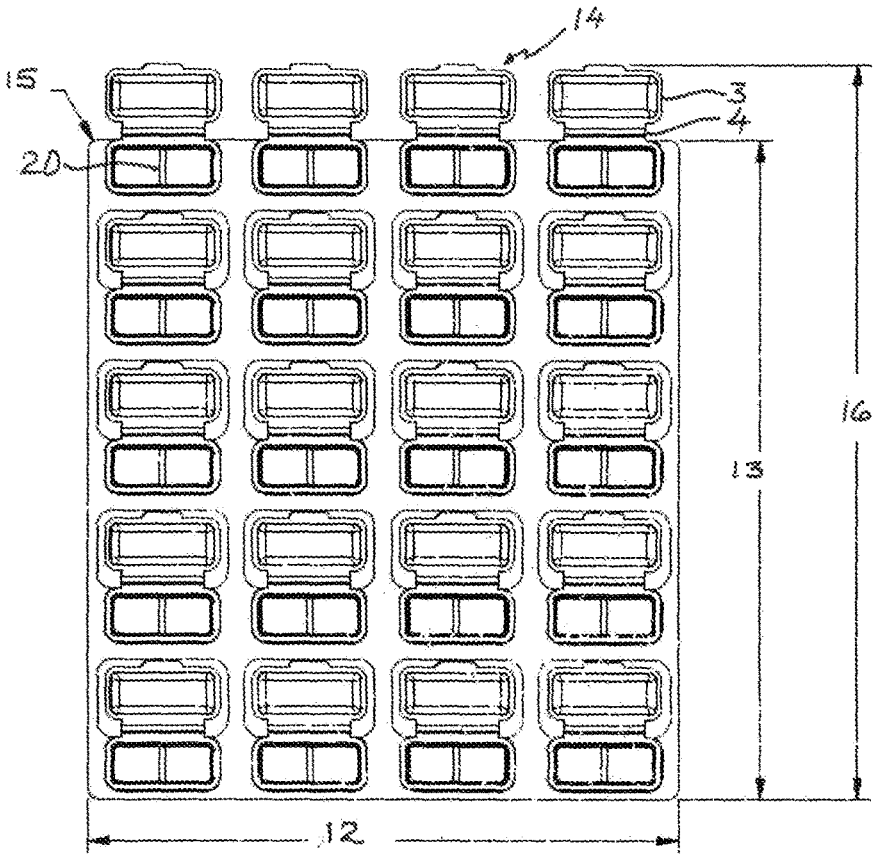
FIG. 2 is a top view of the array shown in FIG. 1.
Figure 3:
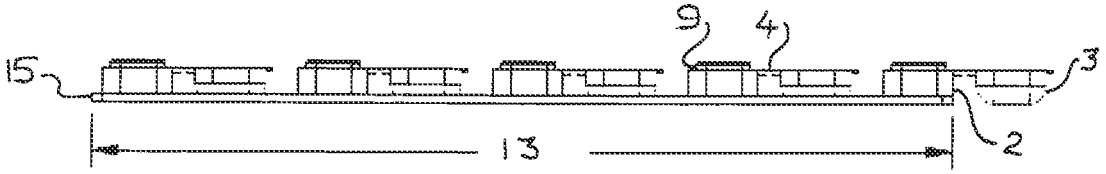
FIG. 3 is a right side view of the array shown in FIG. 1.
Figure 4:
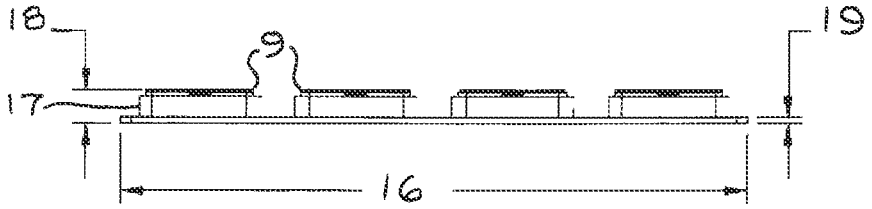
FIG. 4 is a front end view of the array shown in FIG. 1.

FIG. 2 shows a top view of array 1 having four capsule containers 2 across width 12 and five capsule containers 2 over length 13. As formed, the top row 14 of tops 3 extend beyond base plate 15 by the length 16 of base plate 15 plus the length of top 3 and living hinge 4. Capsule container 2 has a base compartment 17 that rises above base plate 15 for a first distance 18 sufficient to contain one capsule. Base plate 15 has a thickness 19 that is sufficient to secure array 1 and provide the degree of rigidity desired by the manufacturer.

As shown in FIG. 2, inner ridge 20 extends across capsule container 2 and provides a surface feature on which a capsule can be tipped so as to raise the opposite end to facilitate removal of capsule 6 from within container 2.

Figure 6:
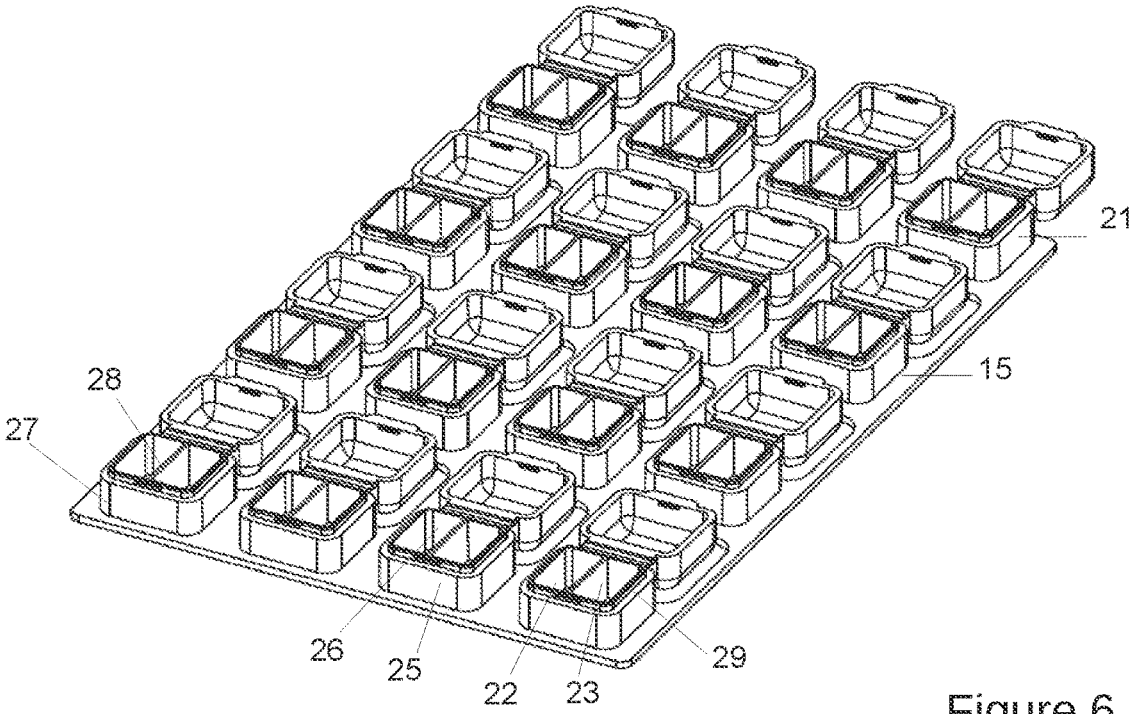
FIG. 6 is a front isometric view of a tablet container array in which each container has two compartments. This is especially useful for pills that require two pills to make a proper dose.
Figure 7:
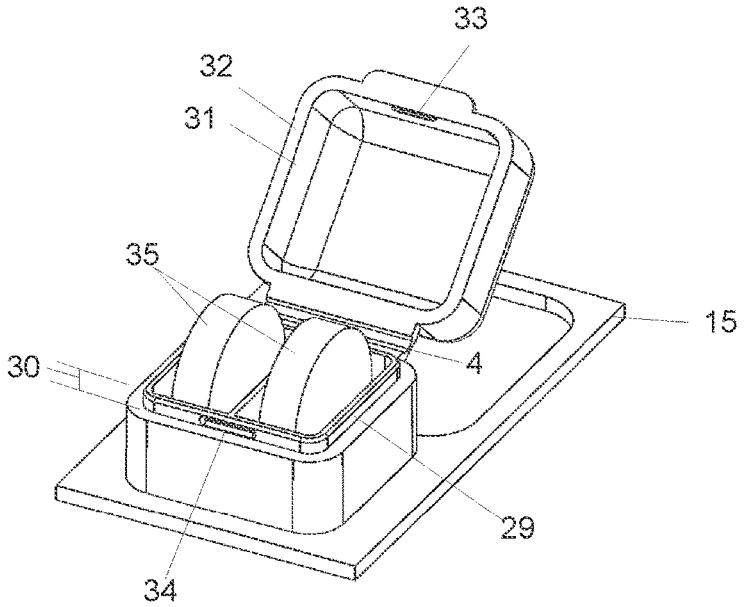
FIG. 7 is a more detailed view of a compartment in the array of FIG. 6.

FIGS. 6 and 7 show a construction for tablet container 21 in which container 21 is divided into two discrete compartments 22 by center wall 23 extending from front wall 25 to rear wall 26 at a height 27 that is substantially the same as the height 28 of walls 25, 26. As with capsule container 2, inner lip 29 rises above walls 25, 26 for a distance 30 and fits in recess 31 in tablet cap 32. Protruding lip portion 33 engages undercut recess portion 34 to form a snap-cap closure for tablets 35. Living hinge is integrally formed between rear wall 26 and tablet cap 32.

Once taught the art of making the invention, many variations are possible, but they cannot include the definitions and bounds of the claims as stated.

What is claimed is:

1. A recyclable plastic array of integrally molded small parts containers made from a single piece of a plastic material with up to 120 separate containers integrally molded with: (a) a container base plate and (b) a plurality of container snap-cap cover lids, each container snap-cap cover lid connected to and integrally molded with each of the separate containers by a living hinge therebetween, said container base plate having a plurality of openings through said base plate, one of which is behind each container in which the lid of said container extends over the base plate when in an open position, the opening dimensioned to allow formation of the container snap-cap cover lid at the same time said container base plate and containers are formed.

2. An array according to claim 1 wherein each container has a front wall and a rear wall with a raised ridge extending therebetween and positioned to allow a capsule resting therein to discernibly tilt up when an opposite end is pressed down.

3. An array according to claim 1 wherein each container has a front wall and a rear wall with a vertical wall extending between the front wall and the rear wall to form two compartments, wherein the container is dimensioned to allow a tablet to be placed on either side of said vertical wall.

4. An array according to claim 1 wherein: (a) each container is defined by raised walls having an upper edge with a raised lip extending around an inner perimeter of said upper edge; and (b) each snap-cap cover lid is defined by perimeter walls corresponding to the raised wall of the container and has an inner recess configured to receive the raised lip of the corresponding container in said inner recess.

5. An array according to claim 4 wherein the inner recess of the snap-cap cover lid exhibits a protruding lip portion that engages a recessed undercut portion on said raised lip.

6. An array according to claim 5 having 20-90 containers in the array.

7. An array according to claim 1 that consists of recyclable plastic.

8. A recyclable plastic array having 20-90 integrally molded small parts containers, said array comprising: (a) a container base plate and (b) 20-90 containers on said container base plate, each container connected via a living hinge to a snap-cap cover lid, said container base plate having a plurality of openings through said base plate, one of which is behind each container in which the lid extends over the base plate in an open position, wherein each opening is dimensioned to allow molding of the container snap-cap cover lid cover when said container base plate and containers are formed, wherein: (a) each container is defined by raised walls having an upper edge with a raised lip extending around an inner perimeter of said upper edge; and (b) each snap-cap cover lid is defined by perimeter walls corresponding to the raised wall of the container to which said lid is connected and has having an inner recess configured to receive the raised lip of the corresponding container base in said inner recess, wherein the inner recess of the snap-cap cover lid exhibits a protruding lip portion that engages a recessed undercut portion on said raised lip, wherein each container has a front wall and a rear wall with a raised ridge extending therebetween.

9. A recyclable plastic array according to claim 8 wherein said raised ridge forms two compartments in the container.

10. An array according to claim 8 wherein said plastic has a translucency within a range from about 10-100%.

* * * * *